US006270598B1

(12) United States Patent
Kasahara et al.

(10) Patent No.: US 6,270,598 B1
(45) Date of Patent: Aug. 7, 2001

(54) PROCESS AND APPARATUS FOR PRODUCING FLAT CABLE

(75) Inventors: Tsukasa Kasahara; Osamu Mochizuki; Masaaki Aoyagi; Satoshi Mizushima, all of Ibaraki (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 09/361,957

(22) Filed: Jul. 27, 1999

(30) Foreign Application Priority Data

May 13, 1999 (JP) ..... 11-132989

(51) Int. Cl.[7] ..... H01B 7/08; H01B 13/00

(52) U.S. Cl. ..... 156/47; 156/50; 29/755; 140/149

(58) Field of Search ..... 156/47, 50, 393; 174/117 F, 34, 36; 29/755; 140/149

(56) References Cited

U.S. PATENT DOCUMENTS 4,034,148 * 7/1977 Lang ..... 174/34
4,359,597 * 11/1982 Paquin et al. ..... 174/34
4,455,818 * 6/1984 Sugimoto et al. ..... 174/117 F
4,767,891 * 8/1988 Biegon et al. ..... 174/34
4,963,222 * 10/1990 Bonjour et al. ..... 156/393

* cited by examiner

*Primary Examiner*—Michael W. Ball
*Assistant Examiner*—John T. Haran
(74) *Attorney, Agent, or Firm*—Scully, Scott, Murphy & Presser

(57) ABSTRACT

A mold is disposed just behind twist ports for forming twisted pair portions of a flat cable. When a plurality of insulated conductors in their portion corresponding to a parallel portion, before fusion, of a flat cable are passed through the twist ports, the rotation of the twist ports is stopped to permit the plurality of insulated conductors to be parallel aligned with an identical pitch. The mold comprises a combination of two molds each having a plurality of grooves for accommodating therein the plurality of insulated conductors delivered from the twist ports. Upon accommodation of the plurality of insulated conductors within the grooves of the mold, fusion between adjacent insulated conductors in their insulative layers is carried out in the mold to form a parallel fused portion. The above constitution can realize a process and an apparatus for producing a flat cable that require neither a large space nor large equipment, can easily vary the spacing between parallel fused portions, and can properly fuse adjacent insulated conductors in their insulative layers to each other to form a parallel fused portion.

10 Claims, 8 Drawing Sheets

PROCESS AND APPARATUS FOR PRODUCING FLAT CABLE

FIELD OF THE INVENTION

The invention relates to a process and an apparatus for producing a flat cable, and more particularly to a process and an apparatus for producing a flat cable that require neither a large space nor large equipment, can easily vary the spacing between parallel fused portions, and can properly fuse adjacent insulated conductors in their insulative layers to each other to form a parallel fused portion.

BACKGROUND OF THE INVENTION

Flat cables comprising parallel fused portions and twisted pair portions provided alternately with the parallel fused portions are known in the art. In these flat cables, the parallel fused portions each are composed of separately insulated conductors which have been disposed side by side, adjacent insulated conductors in their respective insulative layers being fused to each other to form the parallel fused portion. The parallel fused portions permit simultaneous connection of conductors in the flat cable to a connector. On the other hand, the twisted pair portions extend from the parallel fused portions and each are composed of a plurality of twisted pairs juxtaposed to each other or one another. The plurality of twisted pairs each are composed of two conductors which have been separately insulated by an insulative layer and have been twisted together. The twisted pair portions are provided in order to improve electric characteristics of the flat cable.

Conventional processes for producing these flat cables will be explained. According to one conventional process for producing a flat cable (hereinafter often referred to as "first conventional production process"), a plurality of insulated conductors are fed into a twister where adjacent insulated conductors are twisted together to form twisted pairs. The twister is provided with twist ports that are arranged in a row.

When the insulated conductors in their portion corresponding to the twisted pair portion are passed through the twist ports, the twists ports are rotated to form a twisted pair portion. On the other hand, when the insulated conductors in their portion corresponding to the parallel portion are passed through the twist ports, the rotation of the twist ports is stopped to permit the insulated conductors to be parallel aligned to form a parallel aligned portion.

The front end of the parallel aligned portion delivered from the twist ports is first held by forks with one of them providing a space, and the rear end of the parallel aligned portion is then held with the other providing a space, thereby preventing the twists in the twisted pair portion from adversely affecting the parallel aligned portion.

The width of the twisted pair portion and the width of the parallel aligned portion gradually decrease with the progress of the work. This is achieved by virtue of holding by the forks while leaving a slight space. The insulated conductors are then fed into a mold comprising a combination of two molds, an upper mold and a lower mold, for forming a parallel fused portion.

When the forks holding the parallel aligned portion respectively reach both sides of the mold, the upper and lower molds are closed and the mold is then moved in synchronization with the insulated conductors. This permits adjacent insulated conductors constituting the parallel aligned portion to be heat fused to each other to form a parallel fused portion.

After the upper and lower molds are closed, the forks leave the line and are used again. The forks are mounted on a rotary belt that returns the forks to a position at which the twister is provided.

Upon the completion of the formation of the parallel fused portion in the mold, the upper and lower molds are opened to release the formed parallel fused portion, followed by re-operation of the twister. The above procedure is repeated to produce a predetermined flat cable.

Another conventional process for producing a flat cable (hereinafter often referred to as "second conventional production process) will be explained.

In the first conventional production process, the twists ports in the twister are arranged in a row. On the other hand, in the second conventional production process, the twist ports are arranged in the vertical direction as well as in the lateral direction.

Specifically, in the twister, the twist ports are arranged in both the vertical direction and the lateral direction in such a manner that the pitch between insulated conductors passed therethrough is identical.

In the second conventional production process, instead of the forks used in the first conventional production process, an aligning device is used for aligning the insulated conductors. The aligning device comprises a pair of devices, and fine separators are provided between the pair of devices. Each of the fine separators is inserted between adjacent two insulated conductors constituting the insulated conductor pair. The devices are disposed respectively at both ends of the parallel portion. In this state, the aligning device transfers the parallel portion to the position of the mold, thereby preventing the twist in the twisted pair portion from adversely affecting the parallel aligned portion.

Flat cables produced by the above two conventional processes have been utilized as internal wiring materials for various types of electronic equipment including personal computers, and a further increase in demand thereof is expected.

The conventional processes and apparatuses for producing flat cables, however, have the following drawbacks. In the first conventional production process, the distance from the twist ports in the twister to the mold is large. This requires a large space. Further, since the forks are fixed to a belt, it is difficult to vary the spacing between parallel fused portions, that is, the length of the twisted pair portion. Furthermore, many forks, which are disadvantageously expensive, are necessary. An additional problem is such that a large-scale mechanism should be provided for gradually reducing the width of the twisted pair portion and the width of the parallel aligned portion.

On the other hand, the second production process is advantageous in that no remarkably large space is required and, in addition, the necessary number of the aligning device comprising a pair of devices is only one. Since, however, the insulated conductors are arranged in a vertically dispersed state, the insulated conductors become intricate. Therefore, when they are arranged in the horizontal direction, predetermined mutual relationship between the insulated conductors cannot be always provided. This causes the mold to bite the insulated conductors at the time of fusion between adjacent insulated conductors in their insulative layers in the mold, often resulting in damaged insulative layer.

SUMMARY OF THE INVENTION

Accordingly, it is an object of the invention to provide a process and an apparatus for producing a flat cable that require neither a large space nor large equipment, can easily vary the spacing between parallel fused portions, and can properly fuse insulated conductors in their insulative layers to each other to form a parallel fused portion.

According to the first feature of the invention, a process for producing a flat cable, said flat cable comprising: parallel fused portions each having a predetermined length; and twisted pair portions, each having a predetermined length, provided alternately with the parallel fused portions, said twisted pair portions each being composed of a plurality of twisted pairs juxtaposed to each other or one another, said plurality of twisted pairs each being composed of two conductors, which are separately insulated by an insulative layer and are twisted together, said parallel fused portions each being composed of separately insulated conductors which extend from the twisted pair portion and are disposed side by side, adjacent insulated conductors in their respective insulative layers in the parallel fused portion being fused to each other to form the fused portion, comprises the steps of:

feeding a plurality of insulated conductors, each comprising a conductor covered with an insulative layer, juxtaposed to each other or one another into a twister provided with twist ports, said twist ports being constructed so that, when the plurality of insulated conductors in their portion for constituting the twisted pair portion are passed therethrough, the twist ports are rotated to form the twisted pair portion, while when the plurality of insulated conductors in their portion corresponding to the parallel portion before fusion are passed therethrough, the rotation of the twist ports is stopped to permit the plurality of insulated conductors to be parallel aligned with an identical pitch;

delivering the portion corresponding to the parallel portion before fusing from the twist ports to a mold provided just behind the twist ports, said mold comprising a combination of two molds, an upper mold and a lower mold, each having a plurality of grooves for accommodating therein said plurality of juxtaposed insulated conductors;

upon the delivery of the portion corresponding to the parallel portion from the twist port to the position of the mold, stopping the travel of the insulated conductors, accommodating the plurality of insulated conductors in their portion corresponding to the parallel portion within the plurality of grooves of the mold, and closing the upper and lower molds to form the parallel fused portion in the mold; and then opening the upper and lower molds to release the parallel fused portion and again moving the insulated conductors to form the next twisted pair portion in the twist ports.

According to a second feature of the invention, a process for producing a flat cable, said flat cable comprising: parallel fused portions each having a predetermined length; and twisted pair portions, each having a predetermined length, provided alternately with the parallel fused portions, said twisted pair portions each being composed of a plurality of twisted pairs juxtaposed to each other or one another, said plurality of twisted pairs each being composed of two conductors, which are separately insulated by an insulative layer and are twisted together, said parallel fused portions each being composed of separately insulated conductors which extend from the twisted pair portion and are disposed side by side, adjacent insulated conductors in their respective insulative layers in the parallel fused portion being fused to each other to form the fused portion, comprises the steps of:

feeding a plurality of insulated conductors, each comprising a conductor covered with an insulative layer, juxtaposed to each other or one another into a twister provided with twist ports, said twist ports being constructed so that, when the plurality of insulated conductors in their portion for constituting the twisted pair portion are passed therethrough, the twist ports are rotated to form the twisted pair portion, while when the plurality of insulated conductors in their portion corresponding to the parallel portion before fusion are passed therethrough, the rotation of the twist ports is stopped to permit the plurality of insulated conductors to be parallel aligned with an identical pitch;

delivering the portion corresponding to the parallel portion before fusing from the twist ports to a mold provided at a predetermined position just behind the twist ports, said mold comprising a combination of two molds, an upper mold and a lower mold, each having a plurality of grooves for accommodating therein said plurality of juxtaposed insulated conductors;

upon the delivery of the portion corresponding to the parallel portion from the twist port to the position of the mold, accommodating the plurality of insulated conductors in their portion corresponding to the parallel portion within the plurality of grooves of the mold, and closing the upper and lower molds to form the parallel fused portion in the mold;

performing the first travel of the mold in the same direction and speed as used in the travel of the plurality of insulated conductors, opening the upper and lower molds to release the formed parallel fused portion, and performing the second travel of the mold to return the mold to said predetermined position; and utilizing the period between the first travel of the mold and the second travel of the mold to form the next twisted pair portion in the twist port.

According to the third feature of the invention, an apparatus for producing a flat cable, said flat cable comprising: parallel fused portions each having a predetermined length; and twisted pair portions, each having a predetermined length, provided alternately with the parallel fused portions, said twisted pair portions each being composed of a plurality of twisted pairs juxtaposed to each other or one another, said plurality of twisted pairs each being composed of two conductors, which are separately insulated by an insulative layer and are twisted together, said parallel fused portions each being composed of separately insulated conductors which extend from the twisted pair portion and are disposed side by side, adjacent insulated conductors in their respective insulative layers in the parallel fused portion being fused to each other to form the fused portion, comprises:

a moving mechanism which moves at a predetermined speed the plurality of insulated conductors delivered from a delivery device, the operation of the moving mechanism being stopped at the time of the formation of the parallel fused portion and being initiated at the time of the formation of the twisted pair portion;

a twister provided with twist ports, for forming the twisted pair portions, said twist ports being constructed so that, when the plurality of insulated conductors in their portion for constituting the twisted pair portion are moved by the moving mechanism and are passed therethrough, the twist ports are rotated to form the twisted pair portion, while when the plurality of insulated conductors in their portion corresponding to the parallel portion before fusion are passed therethrough, the rotation of the twist ports is stopped to permit the plurality of insulated conductors to be parallel aligned with an identical pitch; and a mold disposed just behind the twist ports, said mold comprising a combination of two molds, an upper mold and a lower mold, each having a plurality of grooves for accommodating therein the plurality of juxtaposed insulated conductors in their portion corresponding to the parallel portion delivered from the twist ports to form the parallel fused portion in the plurality of the insulated conductors.

According to the fourth feature of the invention, an apparatus for producing a flat cable, said flat cable comprising: parallel fused portions each having a predetermined length; and twisted pair portions, each having a predetermined length, provided alternately with the parallel fused portions, said twisted pair portions each being composed of a plurality of twisted pairs juxtaposed to each other or one another, said plurality of twisted pairs each being composed of two conductors, which are separately insulated by an insulative layer and are twisted together, said parallel fused portions each being composed of separately insulated conductors which extend from the twisted pair portion and are disposed side by side, adjacent insulated conductors in their respective insulative layers in the parallel fused portion being fused to each other to form the fused portion, said apparatus comprising:

a first moving mechanism which moves at a predetermined speed the plurality of insulated conductors delivered from a delivery device;

a twister provided with twist ports, for forming the twisted pair portions, said twist ports being constructed so that, when the plurality of insulated conductors in their portion for constituting the twisted pair portion are moved by the moving mechanism and passed therethrough, the twist ports are rotated to form the twisted pair portion, while when the plurality of insulated conductors in their portion corresponding to the parallel portion before fusion are passed therethrough, the rotation of the twist ports is stopped to permit the plurality of insulated conductors to be parallel aligned with an identical pitch;

a mold which is disposed at a predetermined position just behind the twist port and movable by a second moving mechanism as defined below, said mold comprising a combination of two molds, an upper mold and a lower mold, each having a plurality of grooves for accommodating therein the plurality of juxtaposed insulated conductors in their portion corresponding to the parallel portion delivered from the twist ports to form the parallel fused portion in the plurality of the insulated conductors; and a second moving mechanism which, as soon as the plurality of insulated conductors are accommodated within the plurality of grooves followed by closing of the two molding, moves the mold, in synchronization with the movement of the plurality of insulated conductors by the first moving mechanism and, as soon as the upper and lower molds are opened to release the formed parallel fused portion, returns the mold to the predetermined position.

Preferably, the timing of the formation of the parallel fused portion and the timing of the formation of the twisted pair portion are controlled by control means that receives a signal from an instrument for measuring the travel distance of the plurality of insulated conductors on the line and has data on spacing between parallel fused portions which has been previously set and input thereinto. Therefore, in this case, the twister and the mold are operated in response to the signal from the control means.

The length of the twisted pair portion may be variably set by setting several spacings between the parallel fused portions in the control means. Preferably, this setting is simply variable. Varying the setting may be carried out before or during the operation.

Preferably, the plurality of insulated conductors in their portion corresponding to the parallel portion are parallel aligned and then accommodated within the plurality of grooves in the mold. Parallel alignment of the plurality of insulated conductors may be carried out, for example, by an insulated conductor aligning device comprising two plates each having a plurality of concaves for accommodating therein the plurality of insulated conductors. The aligning device is provided on the twist port side of the twister. In this case, although the concaves are, in many cases, in a semicircular form, they may be in a V-shaped form.

After the insulated conductors are accommodated within the concaves of the insulated conductor aligning device, an ironing device having a plurality of concaves for accommodating the plurality of insulated conductors may be moved, with the insulated conductors being accommodated within the plurality of concaves, along the insulated conductors to enhance the aligning effect of the insulated conductor aligning device. The concaves of the ironing device are, in many cases, in a semicircular or V-shaped form. Alternatively, they may be in a flat form.

In the production process wherein the mold is moved in the course of the formation of the parallel fused portion and then returned to the original predetermined position, the return of the mold to the original predetermined position just before the completion of the formation of the next twisted pair portion in the twist ports can enhance the operation efficiency. In this case, preferably, if the return of the mold to the original predetermined position is not completed by the time when the portion corresponding to the next parallel portion is passed through the twist ports, the line is stopped from the viewpoint of the protection of the equipment.

BRIEF DESCRIPTION OF THE DRAWINGS

The invention will be explained in more detail in conjunction with the appended drawing, wherein:

FIGS. 5A to 5C are diagrams showing the principal part of the first preferred embodiment of the invention shown in FIG. 4, wherein FIG. 5A shows a cross-sectional view taken on line A—A of FIG. 4, FIG. 5B a cross-sectional view, taken on line B—B of FIG. 4, with the mold being closed, FIG. 5C a cross-sectional view taken on line C—C of FIG. 4, with the insulated conductor aligning device being closed, and FIG. 5D a cross-sectional view taken on line D—D of FIG. 4 with the ironing device being closed;

Throughout all of the drawings, like parts have the same reference numerals.

DESCRIPTION OF THE PREFERRED EMBODIMENTS

Before describing flat cables and the process and apparatus for producing a flat cable according to preferred embodiments of the invention, the conventional process and apparatus for producing a flat cable will be explained in FIGS. 1 to 3.

Figure 3:
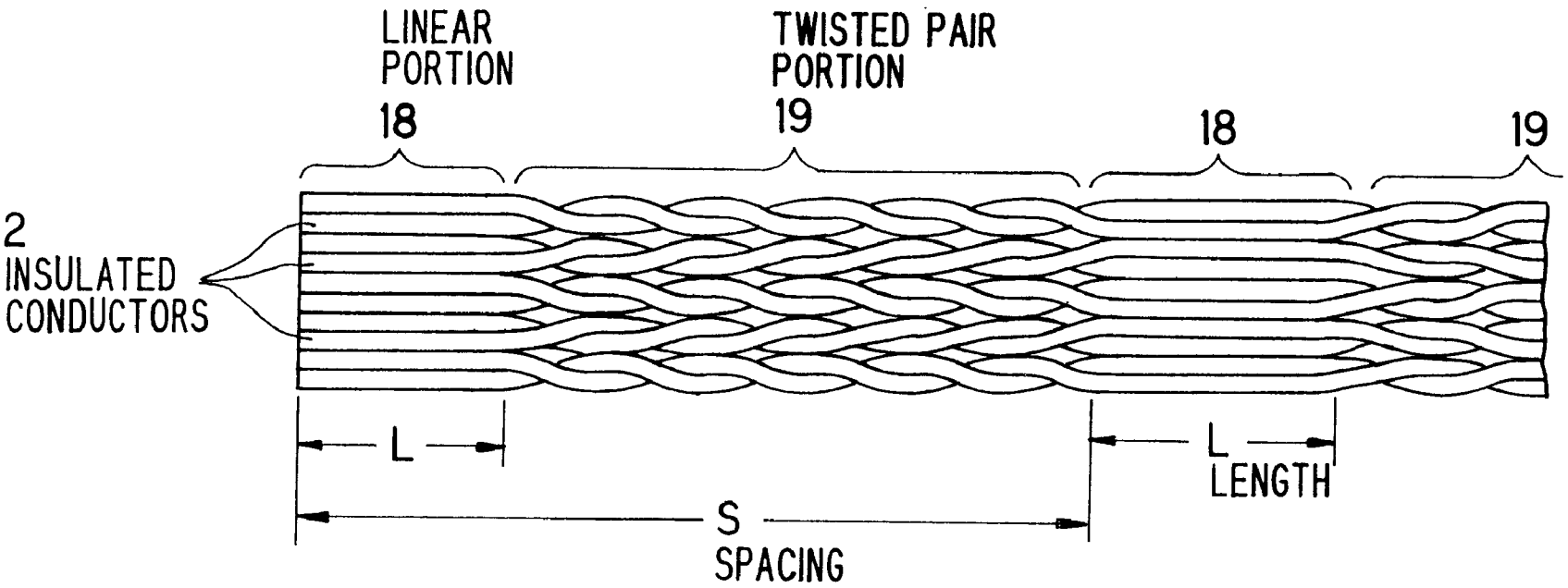
FIG. 3 is a diagram illustrating general construction of a flat cable.

FIG. 3 shows general construction of a flat cable. The flat cable comprises parallel fused portions 18 and twisted pair portions 19 provided alternately with the parallel fused portions 18. The parallel fused portions 18 each are composed of separately insulated conductors 2 which have been disposed side by side, adjacent insulated conductors 2 in their respective insulative layers being fused to each other to form the parallel fused portion. The parallel fused portions 18 permit simultaneous connection of conductors in the flat cable to a connector. On the other hand, the twisted pair portions 19 extend from the parallel fused portions 18 and each are composed of a plurality of twisted pairs juxtaposed to each other or one another. The plurality of twisted pairs each are composed of two conductors which have been separately insulated by an insulative layer and have been twisted together. The twisted pair portions 19 are provided in order to improve electric characteristics of the flat cable.

Figure 1A:
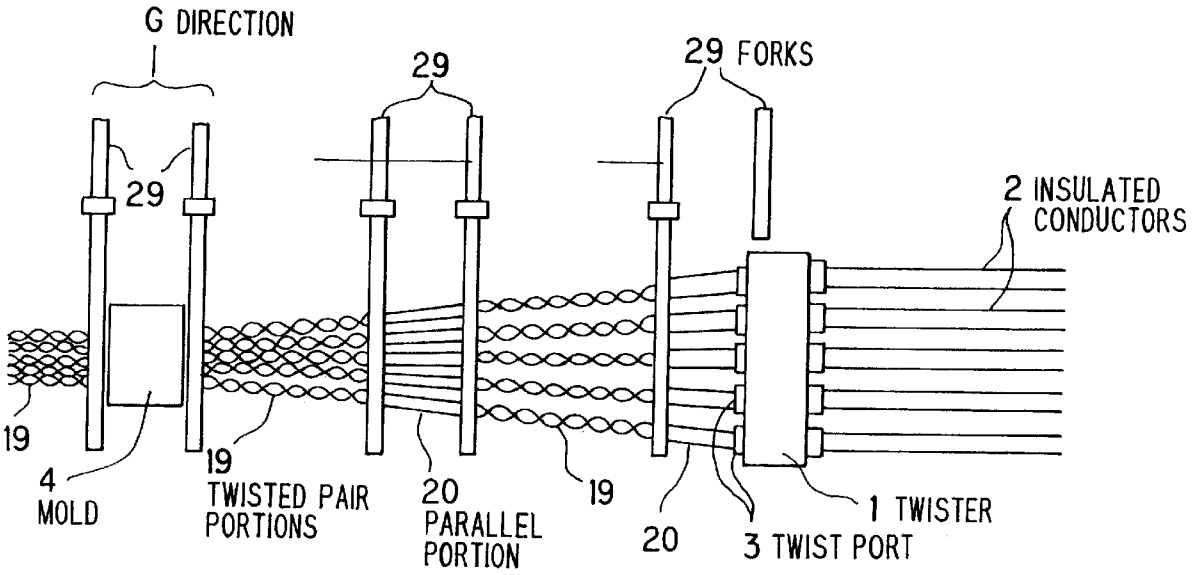
FIG. 1A PRIOR ART
FIGS. 1A and 1B are diagrams illustrating a conventional process and apparatus for producing a flat cable.
Figure 1B:
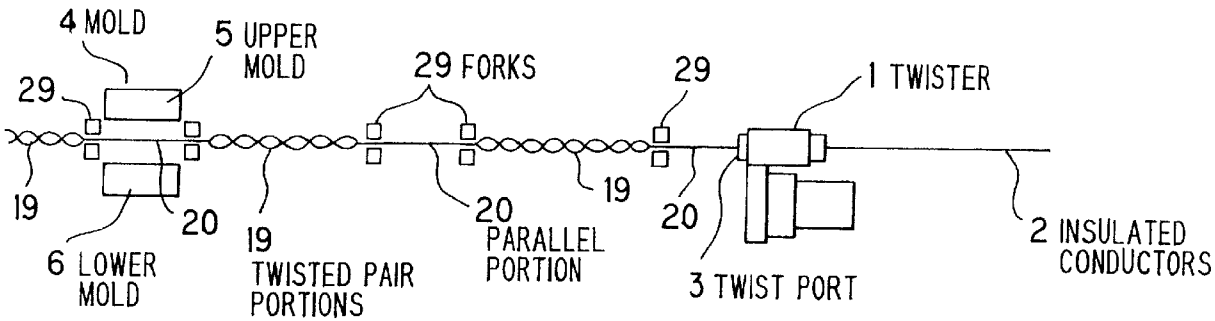
FIG. 1B PRIOR ART

FIGS. 1A and 1B shows the first conventional production process of a flat cable. In this conventional production process, a plurality of insulated conductors 2 are fed into a twister 1 where adjacent insulated conductors 2 are twisted to form twisted pairs. The twister 1 is provided with twist ports 3 that are arranged in a row.

When the insulated conductors in their portion corresponding to the twisted pair portion are passed through the twist ports, the twists ports are rotated to form a twisted pair portion 19. On the other hand, when the insulated conductors 2 in their portion corresponding to the parallel portion are passed through the twist ports 3, the rotation of the twist ports 3 is stopped to permit the insulated conductors 2 to be parallel aligned to form a parallel aligned portion 20.

The front end of the parallel aligned portion 20 delivered from the twist ports 3 is first held by forks 29 with one of them proving a space, and the rear end of the parallel aligned portion 20 delivered from the twist ports 3 is then held with the other providing a space, thereby preventing the twist in the twisted pair portion 19 from adversely affecting the parallel aligned portion 20.

As shown in FIG. 1A, the width of the twisted pair portion 19 and the width of the parallel aligned portion 20 gradually decrease with the progress of the work. This is achieved by virtue of holding by the forks 29 while leaving a slight space. The insulated conductors 2 are then fed into a mold 4 comprising a combination of two molds, an upper mold 5 and a lower mold 6, for forming a parallel fused portion.

As shown in FIG. 1B, when the forks 29 holding the parallel aligned portion 20 respectively reach both sides of the mold 4, the upper and lower molds 5, 6 are closed and the mold 4 is moved in synchronization with the insulated conductors 2. This permits adjacent conductors 2 constituting the parallel aligned portion 20 to be heat fused to each other to form a parallel fused portion 18 as shown in FIG. 3.

After the upper and lower molds 5, 6 are closed, the forks 29 leave the line in such a manner as indicated by G in FIG. 1A and are used again. The forks 29 are mounted on a rotary belt that returns the forks 29 to the position of the twister 1.

Upon the completion of the formation of the parallel fused portion 18 in the mold 4, the upper and lower molds 5, 6 are opened to release the formed parallel fused portion 18, followed by re-operation of the twister 1. The above procedure is repeated to produce a predetermined flat cable.

The second conventional production process of a flat cable will be explained in FIGS. 2A to 2C.

In the first conventional production process shown in FIGS. 1A and 1B, the twists ports 3 of the twister 1 are arranged in a row. On the other hand, in the second production process, the twist ports 3 are arranged in the vertical direction as well as in the lateral direction.

Figure 2A:
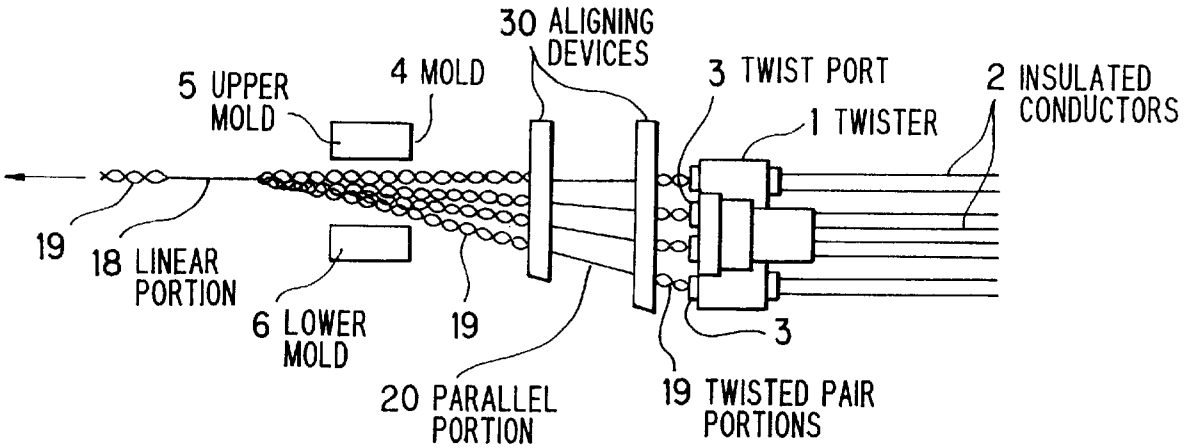
FIG.2A PRIOR ART
FIGS. 2A to 2C are diagrams illustrating another conventional process and apparatus for producing a flat cable.
Figure 2C:
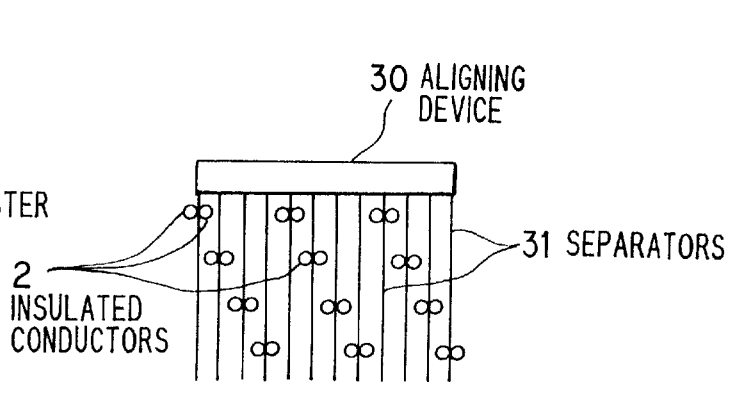
FIG.2C PRIOR ART
Figure 2B:
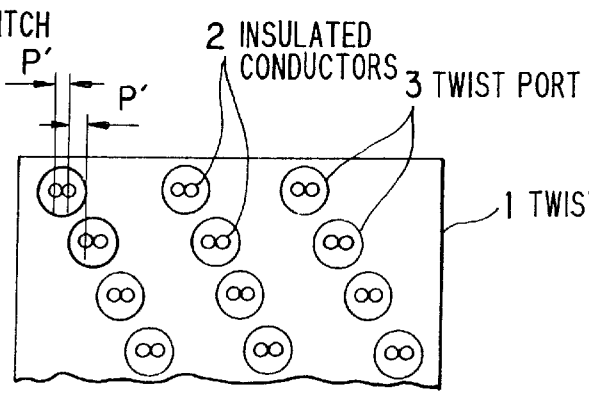
FIG.2B PRIOR ART

In the twister 1 shown in FIG. 2A, the twist ports 3 are arranged in both the vertical direction and the lateral direction in such a manner that, as shown in FIG. 2B, the pitch P' between insulated conductors 2 passed therethrough is identical.

In the second conventional production process shown in FIGS. 2A to 2C, instead of the forks 29 used in the first conventional production process shown in FIG. 1, an aligning device 30 is used for aligning the insulated conductors 2. The construction of the aligning device 30 is shown in FIG. 2C. The aligning device 30 comprises a pair of devices, and fine separators 31 are provided between the pair of devices. Each of the fine separators 31 is inserted between two adjacent insulated conductors 2 constituting the insulated conductor pair. The devices constituting the aligning device 30 are disposed respectively at both ends of the parallel aligned portion 20. In this state, the aligning device 30 transfers the parallel aligned portion 20 to the position of the mold 4, thereby preventing the twist in the twisted pair portion 19 from adversely affecting the parallel portion 20.

Flat cables produced by the above two conventional processes have been utilized as internal wiring materials for various types of electronic equipment including personal computers, and a further increase in demand thereof is expected.

The conventional processes and apparatuses for producing flat cables, however, have the following drawbacks. In the first conventional production process, the distance from the twist ports 2 in the twister 1 to the mold 4 is large. This requires a large space. Further, since the forks 29 are fixed to a belt, it is difficult to vary the spacing between parallel fused portions 18, that is, the length of the twisted pair portion 19. Furthermore, many forks 29, which are disadvantageously expensive, are necessary. An additional problem is such that a large-scale mechanism (not shown) should be provided for gradually reducing the width of the twisted pair portion 19 and the width of the parallel aligned portion 20.

On the other hand, the second production process is advantageous in that no remarkably large space is required and, in addition, the necessary number of the aligning device 30 comprising a pair of devices is only one. Since, however, the insulated conductors 2 are arranged in a vertically dispersed state, the insulated conductors 2 become intricate. Therefore, when they are arranged in the horizontal direction, predetermined mutual relationship between the insulated conductors 2 cannot be always provided. This causes the mold 4 to bite the insulated conductors 2 at the time of fusion between adjacent insulated conductors 2 in their insulative layers in the mold 4, often resulting in damaged insulative layer.

Next, the first preferred embodiment of the process and apparatus for producing a flat cable according to the invention will be explained in FIGS. 4 to 8.

Figure 4:
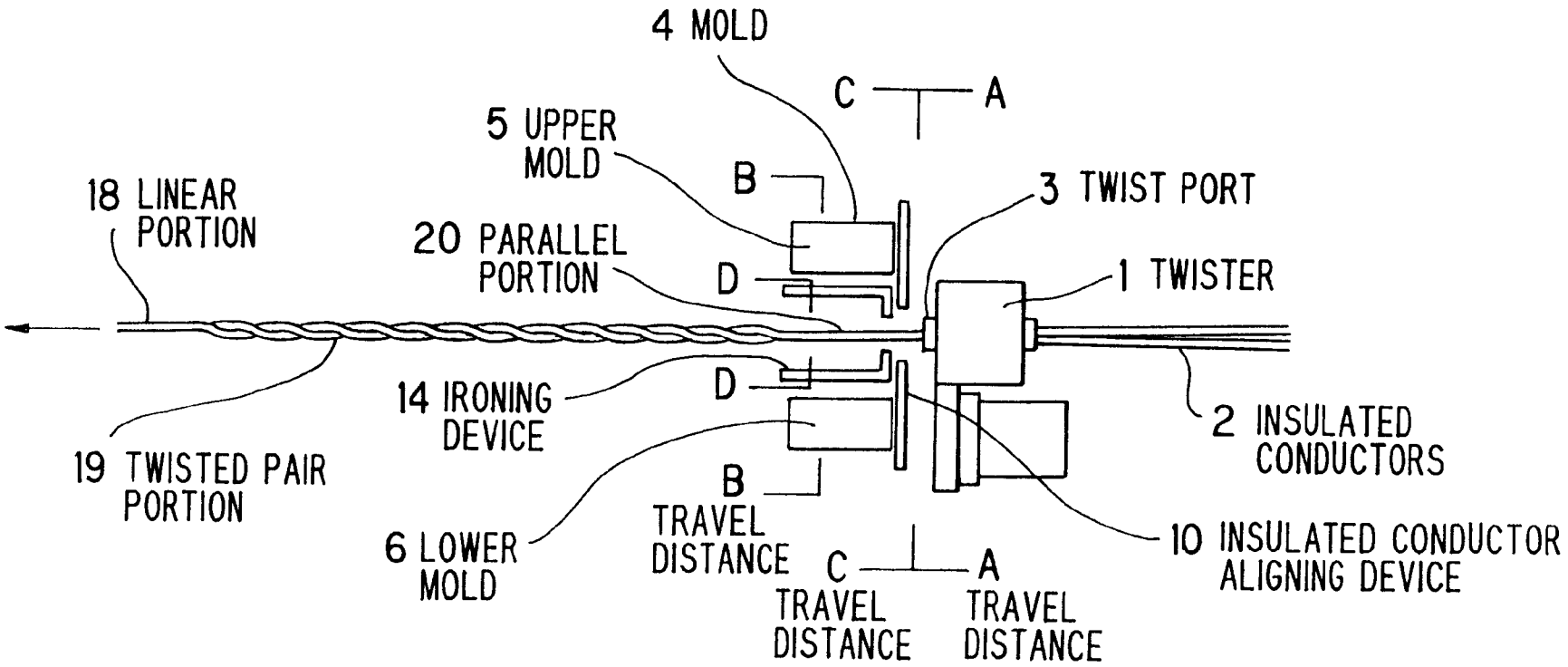
FIG. 4 is a diagram illustrating the process and apparatus for producing a flat cable according to the first preferred embodiment of the invention.
Figure 5A:
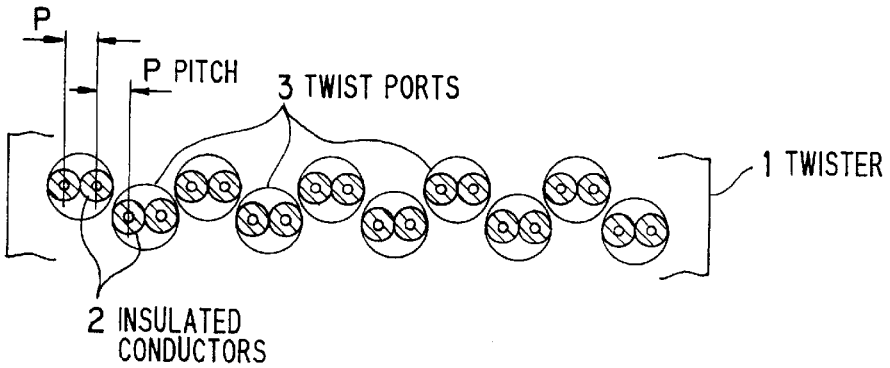
Figure 5B:
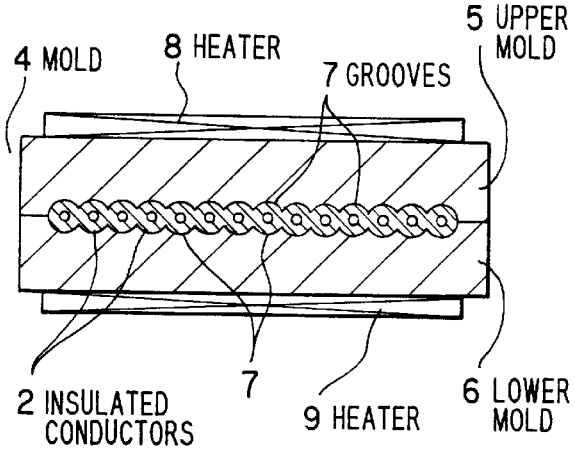
Figure 5C:
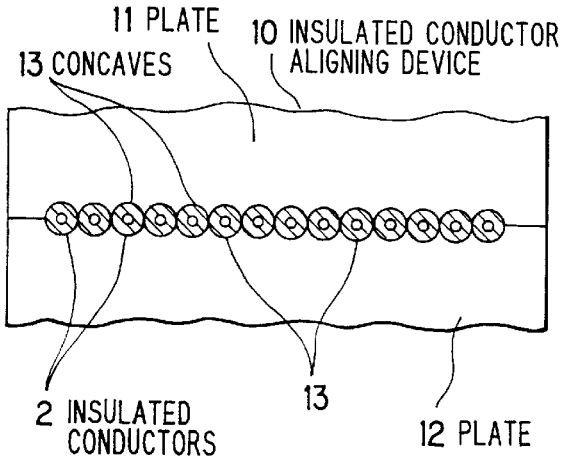

FIG. 4 is a diagram illustrating the process and apparatus for producing a flat cable according to the first preferred embodiment of the invention, and FIGS. 5A to 5C are diagrams showing the principal part of the first preferred embodiment of the invention shown in FIG. 4.

In FIG. 4 and FIGS. 5A to 5C, numeral 1 designates a twister, numeral 2 a plurality of insulated conductors fed in a juxtaposed state into the twister 1, and numeral 3 twist ports of the twister 1. As shown in FIG. 5A, the twist ports 3 are arranged in a row.

The twist ports 3 are constructed so that, when the rotation of the twist ports is stopped, the insulated conductors are arranged as shown in FIG. 5A, that is, with the pitch P between insulated conductors being identical.

Numeral 4 designates a mold disposed just behind the twist ports 3 of the twister 1. The mold 4 comprises a combination of two molds, an upper mold 5 and a lower mold 6.

FIG. 5B shows the construction of the mold 4. A plurality of grooves 7 for accommodating therein the insulated conductors 2 are provided in both the upper mold 5 and the lower mold 6. Heaters 8, 9 are mounted respectively on the upper mold 5 and the lower mold 6.

In FIG. 4, numeral 10 designates an insulated conductor aligning device provided between the mold 4 and the twist ports 3.

The closed state of the aligning device 10 is shown in FIG. 5C. The aligning device 10 comprises a combination of two plates, an upper plate 11 and a lower plate 12. The plates 11, 12 each have a plurality of concaves 13 for accommodating therein the insulated conductors 2.

In FIG. 4, numeral 14 designates an ironing device for insulated conductors.

Figure 5D:
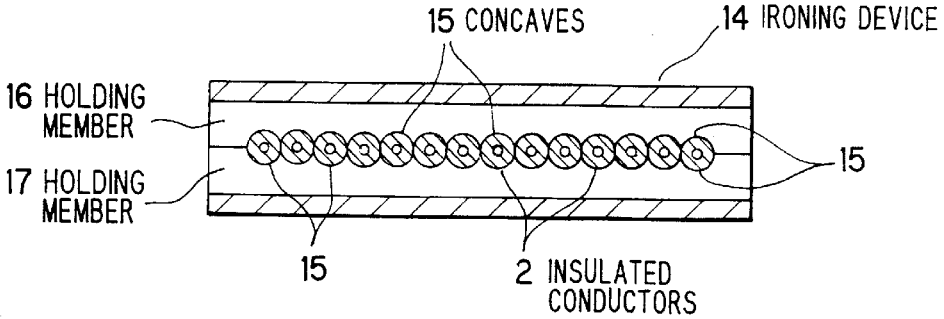

The closed state of the ironing device 14 is shown in FIG. 5D. The ironing device 14 comprises a pair of upper and lower holding members 16, 17 each having a plurality of concaves 15 corresponding to the insulated conductors 2.

In FIG. 4, numeral 18 designates a parallel fused portion formed by heat fusion between adjacent insulated conductors 2 in the mold 4, numeral 19 a twisted pair portion formed by the rotation of the twist port 3, and numeral 20 a parallel aligned portion corresponding to the parallel fused portion 18.

Figure 6A:
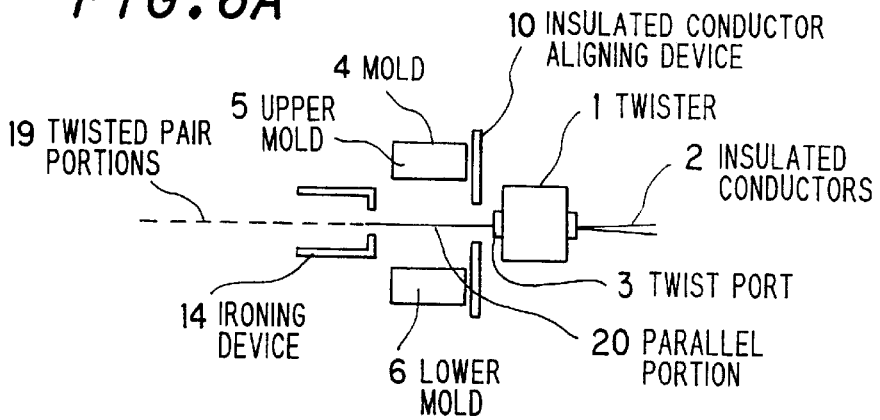
FIGS. 6A to 6H are simulation diagrams illustrating the sequence of operation in the line shown in FIG. 4.
Figure 6B:
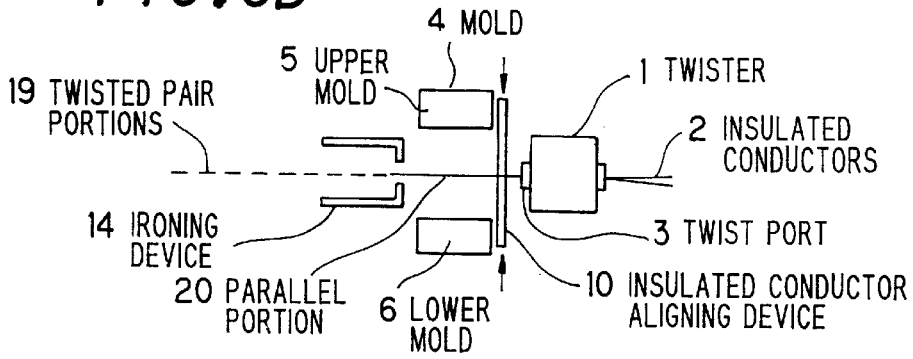

FIGS. 6A to 6H are diagrams illustrating the sequence of operation in the line having the above construction. In FIG. 6, a dotted line represents a twisted pair portion. At the outset, as shown in FIG. 6A, as soon as the twisted pair portion 19 having a predetermined length is formed, the parallel aligned portion 20 is delivered by a predetermined length to the position of the mold 4, the line is stopped. As shown in FIG. 6B, the insulated conductor aligning device 10 is closed, and, as shown in FIG. 5C, the insulated conductors 2 are held within the concaves 13 of the aligning device 10.

Figure 6C:
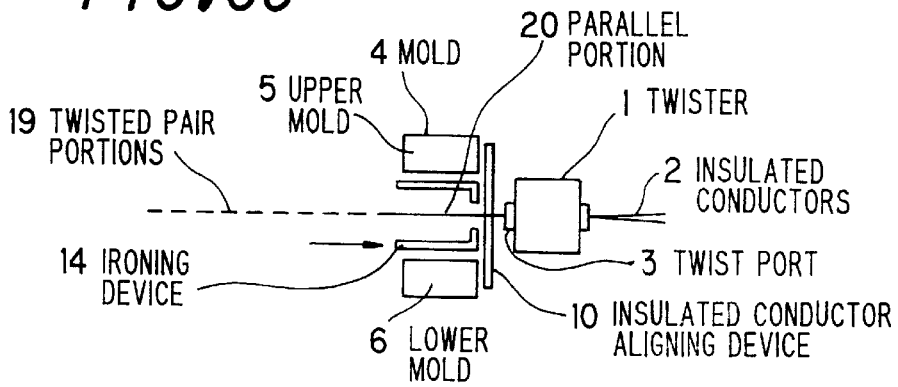
Figure 6D:
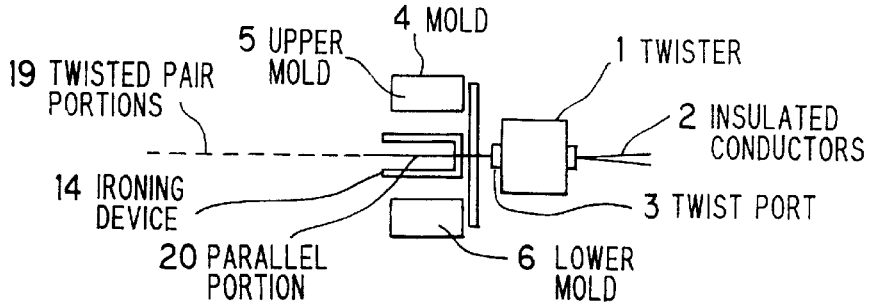

Next, after the ironing device 14 enters the mold 4 as shown in FIG. 6C, in the step shown in FIG. 6D, the insulated conductors 2 are accommodated within the concaves 15 as shown in FIG. 5D.

The insulated conductors 2 are loosely fitted into the concaves 15. In this state, the ironing device 14 is moved to a position shown in FIG. 6E.

Figure 6E:
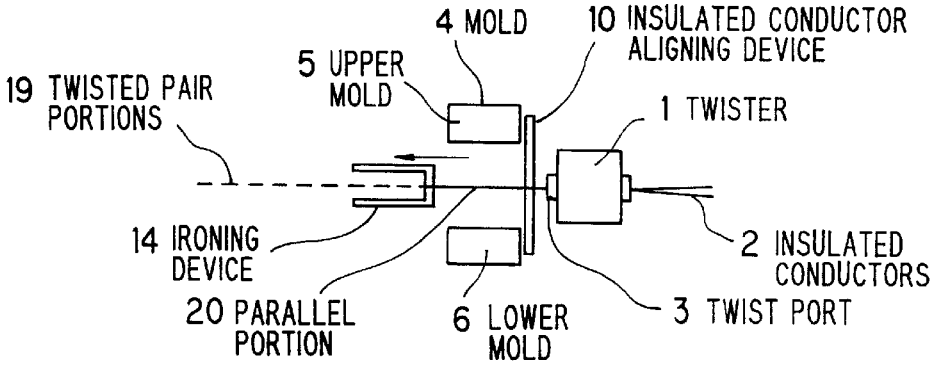
Figure 6F:
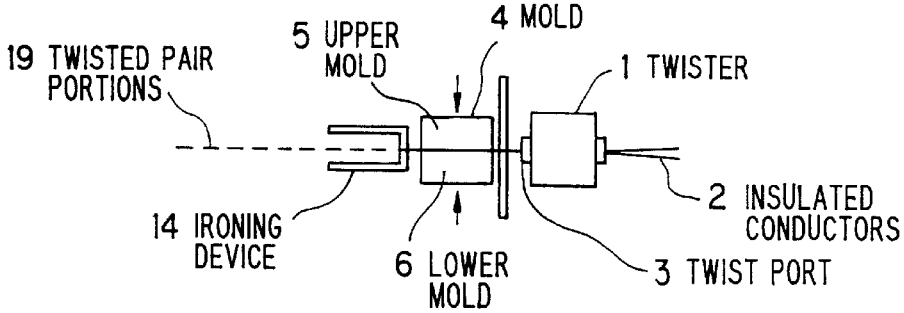

The insulated conductors 2 shown in FIG. 6E are in the state of parallel alignment created by the insulated conductor aligning device 10 and the ironing device 14. Next, in this state, the upper mold 5 and the lower mold 6 in the mold 4 are closed as shown in FIG. 6F to accommodate the insulated conductors 2 within the grooves 7 in the upper mold 5 and the lower mold 6 as shown in FIG. 5B.

Figure 6G:
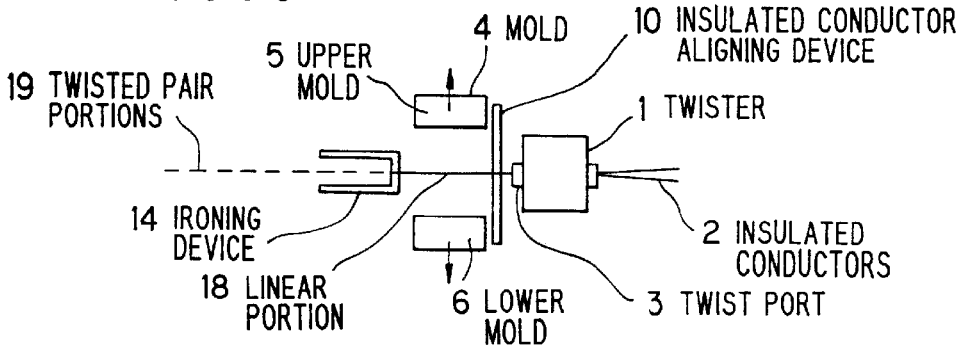
Figure 6H:
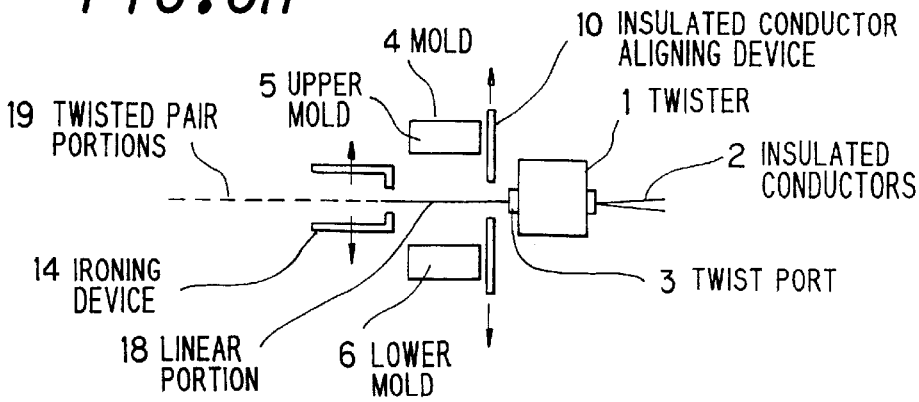

In this state, the parallel aligned portion 20 is heated at a predetermined temperature for a predetermined period of time. Thereafter, as shown in FIG. 6G, the upper and lower molds 5, 6 are opened, and the parallel fused portion 18 is removed from the mold 4, followed by cooling by air spraying or the like to a predetermined temperature. Thereafter, as shown in FIG. 6H, the ironing device 14 is opened for return to the original position, and the insulated conductor aligning device 10 is then opened.

Next, the operation of the line is restarted to form the next twisted pair portion 19. The above operation is repeated to produce a predetermined flat cable.

The operation can be fully automatically performed.

The control of the rotation of the twist ports 3 relative to the travel distance of the insulated conductors 2 is based on the point in time when the insulated conductor aligning device 10 has been actuated (that is, when the insulated conductor aligning device 10 has been closed or opened). At the same time that the insulated conductor aligning device 10 is closed or opened, the measurement of the travel distance of the insulated conductors 2 is started. When the insulated conductors have been moved by a certain distance A, the twist ports 3 are rotated to initiate the twisted pair portion 19. When the travel distance has reached a certain value B, the rotation of the twist ports 3 is stopped. At that time, the state of the twist ports 3 is as shown in FIG. 5A.

When the spacing has reached S in FIG. 3, the insulated conductor aligning device 10 is closed again. The procedure is then repeated. The control of the above operation may be programmed.

In this case, the following relationship should be satisfied: $0<A<B<(S-L)$ wherein A, B and S are as defined above and L is the length of the parallel fused portion 18 as shown in FIG. 3. Further, the travel distance A between the completion of the formation of the parallel fused portion 18 and the initiation of the formation of the twisted pair portion 19, and the travel distance $(S-L)-B$ between the completion of the formation of the twisted pair portion 19 and the initiation of the formation of the parallel fused portion 18 should increase with increasing the number of twists in the twisted pair portion 19, in other words, with increasing the length of the twisted pair portion 19. This is because the influence of the twists on the parallel aligned portion 20 increases with increasing the number of twists in the twisted pair portion 19.

Large equipment like the forks 29 shown in FIGS. 1A and 1B is not required in the above line construction, because the mold 4 is provided just behind the twist ports 3. This arrangement could have been realized by virtue of the feed of the parallel aligned portion 20 delivered from the twists ports 3 into the mold 4 in such a state that, as shown in FIG. 5A, the insulated conductors 2 are arranged by the twist ports 3 with an identical pitch P between the insulated conductors 2. Heat fusion between adjacent insulated conductors in their parallel aligned portion 20 can be carried out in the mold 4 with high parallel alignment accuracy. The presence of the insulated conductor aligning device 10 and the ironing device 14 further enhances this accuracy.

According to FIG. 6H, a parallel fused portion 18 in a flat plate form formed by heat fusing adjacent insulated conductors 2 to each other and cooling the resultant parallel fused portion to completely solidify the fused portion is present before the next twisted pair portion 19 delivered from the twist ports 3. This permits the twisting force involved in the formation of the twisted pair portion 19 to be caught by the parallel fused portion 18. Therefore, opening of the upper mold 5 and the lower mold 6 does not adversely affect the formation of the twisted pair portion 19.

Further, in the preferred embodiment of the invention shown in FIG. 6, unlike the conventional production processes shown in FIGS. 1 and 2, there is no transfer of the parallel aligned portion 20 corresponding to the parallel fused portion 18 by the forks, the aligning device or the like. Therefore, the spacing between parallel fused portions 18 can be easily varied by varying the time taken for the formation of the twisted pair portion 19.

Figure 7:
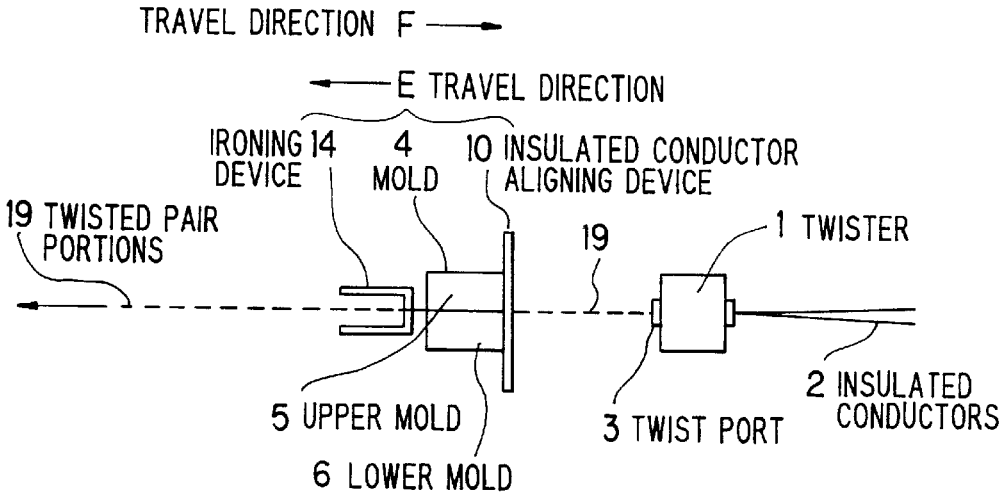
FIG. 7 is a diagram illustrating the process and apparatus for producing a flat cable according to another preferred embodiment of the invention.

FIG. 7 shows the second preferred embodiment of the invention.

The construction of the preferred embodiment shown in FIG. 7 is the same as the preferred embodiment shown in FIGS. 4 to 6, except that the mold 4, the insulated conductor aligning device 10, and the ironing device 14 are moved in synchronization with the movement of the insulated conductors 2.

In FIG. 7, at the same time that closing of the insulated conductor aligning device 10 is initiated, the first movement of the mold 4, the insulated conductor aligning device 10, and the ironing device 14 is carried out in a direction indicated by an arrow E. The speed of this movement is the same as the line speed.

As son as the upper mold 5 and the lower mold 6 are opened after the formation of the parallel fused portion 18, cooling is carried out in a predetermined manner. Therefore, the insulated conductor aligning device 10 and the ironing device 14 are opened and are moved as the second movement in a direction indicated by an arrow F to return the mold 4, the insulated conductor aligning device 10, and the ironing device 14 to the original position shown in FIG. 6. The speed of the second movement may be set as desired. However, the higher the speed of the second movement, the higher the speed of the movement of insulated conductors 2 and in its turn the higher the operating efficiency.

During this time, the twister 1 rotates the twister ports 3 to form the next twisted pair portion 19.

Therefore, in this preferred embodiment, the line is not stopped. This can enhance the operating efficiency and results in the production of predetermined flat cables at low cost. In order to avoid the creation of an idle time, the line construction is preferably such that the second movement is completed before the completion of the formation of the next twisted pair portion 15.

Figure 8:
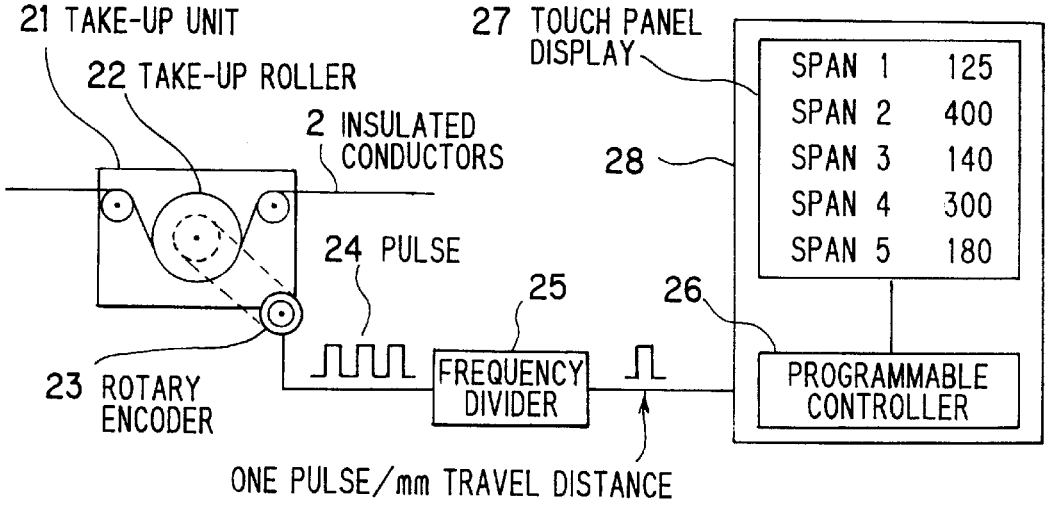
FIG. 8 is a preferred embodiment of the setting of the spacing between parallel fused portions in the invention.

According to the invention, the spacing between parallel fused portions 18 may be controlled, for example, by a method shown in FIG. 8. In FIG. 8, numeral 21 designates a take-up unit for the insulated conductors 2, and numeral 22 a take-up roller provided in the center of the take-up unit 21. A rotary encoder 23 is provided on the take-up roller 22. The rotary encoder 23 converts the rotation of the take-up roller 22 to a pulse 24 which is output to a frequency divider 25. The frequency divider 25 performs conversion in one pulse per mm travel distance.

Numeral 26 designates a programmable controller (sequencer). The programmable controller 26 reads the pulse from the frequency divider 25, performs computation, and performs various operations based on the results. Numeral 27 designates a touch panel display connected to a programmable controller 26.

Contents indicated on the display 27 are, for example, as shown in the drawing, and a desired span length (spacing between parallel fused portions 18) may be selected from a plurality of lengths. In the drawing, setting is such that, in the production of a flat cable, spacings between parallel fused portions (length of twisted pair portion) of 125 mm, 400 mm, 140 mm, 300 mm, and 180 mm are repeated in this order. When this setting is changed to bring the spans 2 to 5 to zero, a flat cable with the spacing between parallel fused portions 18 being constant (125 mm) is produced.

According to this system, unlike setting of span by a counter, the number of spans set can be increased by programming. This offers high diversity and is practical. A portion indicated by numeral 28 in the drawing may be replaced with a personal computer.

As described above, according to the process and apparatus for producing a flat cable according to the invention, a mold is disposed just behind twist ports for forming twisted pair portions of a flat cable. When a plurality of insulated conductors in their portion corresponding to a parallel portion, before fusion, of a flat cable are passed through the twist ports, the rotation of the twist ports is stopped to permit the plurality of insulated conductors to be parallel aligned with an identical pitch. The mold comprises a combination of two molds each having a plurality of grooves for accommodating therein the plurality of insulated conductors delivered from the twist ports. Upon accommodation of the insulated conductors delivered from the twist ports within the plurality of grooves of the mold, fusion between adjacent insulated conductors in their insulative layers is carried out in the mold to form a parallel fused portion. This construction eliminates the need to provide a conventional mechanism for holding the insulated conductors in their portion corresponding to the parallel fused portion over a large length. Therefore, flat cables can be produced in a small space, and the parallel fused portions can be surely formed with a high accuracy.

Further, the spacing between parallel fused portions can be easily varied by varying the length of the twisted pair portion. This can realize the production of a wide variety of flat cables with various spacings between parallel fused portions.

The invention has been described in detail with particular reference to preferred embodiments, but it will be understood that variations and modifications can be effected within the scope of the invention as set forth in the appended claims.

What is claimed is:

1. A process for producing a flat cable comprising: parallel fused portions each having a predetermined length; and twisted pair portions, each having a predetermined length, provided alternately with the parallel fused portions, said twisted pair portions each being composed of a plurality of twisted pairs juxtaposed to each other or one another, said plurality of twisted pairs each being composed of two conductors, which are separately insulated by an insulative layer and are twisted together, said parallel fused portions each being composed of separately insulated conductors which extend from the twisted pair portion and are disposed side by side, adjacent insulated conductors in their respective insulative layers in the parallel fused portion being fused to each other to form the fused portion, said process comprising the steps of:

feeding a plurality of insulated conductors, each comprising a conductor covered with an insulative layer, juxtaposed to each other or one another into a twister provided with twist ports, said twist ports being constructed so that, when the plurality of insulated conductors in their portion for constituting the twisted pair portion are passed therethrough, the twist ports are rotated to form the twisted pair portion, while when the plurality of insulated conductors in their portion corresponding to the parallel portion before fusion are passed therethrough, the rotation of the twist ports is stopped to permit the plurality of insulated conductors to be parallel aligned with an identical pitch;

delivering the portion corresponding to the parallel portion before fusing from the twist ports to a mold located proximately to a conductor output side of the twist ports, said mold comprising a combination of two molds, an upper mold and a lower mold, each having a plurality of grooves for accommodating therein said plurality of juxtaposed insulated conductors;

upon the delivery of the portion corresponding to the parallel portion from the twist port to the position of the mold, stopping the travel of the insulated conductors, accommodating the plurality of insulated conductors in their portion corresponding to the parallel portion within the plurality of grooves of the mold, and closing the upper and lower molds to form the parallel fused portion in the mold; and then opening the upper and lower molds to release the parallel fused portion and again moving the insulated conductors to form the next twisted pair portion in the twist ports.

2. The process according to claim 1, wherein the timing of the formation of the parallel fused portion and the timing of the formation of the twisted pair portion are controlled by control means that receives a signal from an instrument for measuring the travel distance of the plurality of insulated conductors and has data on spacing between parallel fused portions which has been previously set and input thereinto.

3. The process according to claim 2, wherein, in the control means, the length of the twisted pair portion is variably set by setting several spacings between the parallel fused portions.

4. The process according to claim 1, wherein the plurality of insulated conductors are disposed side by side and then accommodated within the plurality of grooves of the mold.

5. A process for producing a flat cable comprising: parallel fused portions each having a predetermined length; and twisted pair portions, each having a predetermined length, provided alternately with the parallel fused portions, said twisted pair portions each being composed of a plurality of twisted pairs juxtaposed to each other or one another, said plurality of twisted pairs each being composed of two conductors, which are separately insulated by an insulative layer and are twisted together, said parallel fused portions each being composed of separately insulated conductors which extend from the twisted pair portion and are disposed side by side, adjacent insulated conductors in their respective insulative layers in the parallel fused portion being fused to each other to form the fused portion, said process comprising the steps of:

feeding a plurality of insulated conductors, each comprising a conductor covered with an insulative layer, juxtaposed to each other or one another into a twister provided with twist ports, said twist ports being constructed so that, when the plurality of insulated conductors in their portion for constituting the twisted pair portion are passed therethrough, the twist ports are rotated to form the twisted pair portion, while when the plurality of insulated conductors in their portion corresponding to the parallel portion before fusion are passed therethrough, the rotation of the twist ports is stopped to permit the plurality of insulated conductors to be parallel aligned with the identical pitch;

delivering the portion corresponding to the parallel portion before fusing from the twist ports to a mold provided at a predetermined position located proximately to a conductor output side of twist ports, said mold comprising a combination of two molds, an upper mold and a lower mold, each having a plurality of grooves for accommodating therein said plurality of juxtaposed insulated conductors;

upon delivery of the portion corresponding to the parallel portion from the twist port to the position of the mold, accommodating the plurality of insulated conductors in their portion corresponding to the parallel portion within the plurality of grooves of the mold, and closing the upper and lower molds to form the parallel fused portion in the mold;

performing a first travel of the mold in the same direction and speed as used in the travel of the plurality of insulated conductors, opening the upper and lower molds to release the formed parallel fused portion, and performing a second travel of the mold to return the mold to said predetermined position; and utilizing the period between the first travel of the mold and the second travel of the mold to form the next twisted pair portion in the twist port.

6. The process according to claim 5, wherein the second travel of the mold is completed before the formation of the next twisted pair portion is completed in the twist ports.

7. The process according to claim 5, wherein, if the second travel of the mold to return the mold to said predetermined position is not completed by the time when the portion corresponding to the next parallel portion is passed through the twist ports, the travel of the insulated conductors is stopped.

8. The process according to claim 5, wherein the timing of the formation of the parallel fused portion and the timing of the formation of the twisted pair portion are controlled by control means that receives a signal from an instrument for measuring the travel distance of the plurality of insulated conductors and has data on spacing between parallel fused portions which has been previously set and input thereinto.

9. The process according to claim 8, wherein, in the control means, the length of the twisted pair portion is variably set by setting several spacings between the parallel fused portions.

10. The process according to claim 5, wherein the plurality of insulated conductors are disposed side by side and then accommodated within the plurality of grooves of the mold.

* * * * *